US008255221B2

(12) United States Patent
Groeger et al.

(10) Patent No.: US 8,255,221 B2
(45) Date of Patent: Aug. 28, 2012

(54) GENERATING A WEB PODCAST INTERVIEW BY SELECTING INTERVIEW VOICES THROUGH TEXT-TO-SPEECH SYNTHESIS

(75) Inventors: Steve Groeger, Poole Dorset (GB); Brian Heasman, Oostduinkerke (BE); Christopher von Koschembahr, Ridgefield, CT (US); Yuk-Lun Wong, Romsey (GB)

(73) Assignee: International Business Machines Corporation, Armonk, NY (US)

( * ) Notice: Subject to any disclaimer, the term of this patent is extended or adjusted under 35 U.S.C. 154(b) by 939 days.

(21) Appl. No.: 12/326,030

(22) Filed: Dec. 1, 2008

(65) Prior Publication Data

US 2009/0144060 A1 Jun. 4, 2009

(30) Foreign Application Priority Data

Dec. 3, 2007 (EP) ..... 07122158

(51) Int. Cl.
*G10L 13/00* (2006.01)

(52) U.S. Cl. ..... 704/260; 704/266; 704/278

(58) Field of Classification Search ..... 704/258, 704/260, 266, 269, 261, 278
See application file for complete search history.

(56) References Cited

U.S. PATENT DOCUMENTS

| | | | | |
|---|---|---|---|---|
| 6,819,338 | B2 * | 11/2004 | Heasman et al. | 715/730 |
| 7,590,689 | B2 * | 9/2009 | Draper et al. | 709/204 |
| 2007/0118378 | A1 * | 5/2007 | Skuratovsky | 704/260 |
| 2007/0214485 | A1 * | 9/2007 | Bodin et al. | 725/101 |
| 2007/0244700 | A1 * | 10/2007 | Kahn et al. | 704/235 |
| 2008/0005347 | A1 * | 1/2008 | Ott | 709/231 |
| 2008/0040328 | A1 * | 2/2008 | Verosub | 707/3 |
| 2008/0046948 | A1 * | 2/2008 | Verosub | 725/117 |
| 2008/0189391 | A1 * | 8/2008 | Koberstein et al. | 709/218 |
| 2008/0255686 | A1 * | 10/2008 | Irvin et al. | 700/94 |
| 2009/0006096 | A1 * | 1/2009 | Li et al. | 704/260 |

OTHER PUBLICATIONS

"MT-Podcast", www.magnetictime.com/news_desk/inthenews/130306_ipod.html, (downloaded Jul. 17, 2008).

"G Cast—a pod casting service", www.gcast.com, (downloaded Jul. 17, 2008).

David Holmes, "Podvox: Practical Voice Recording Tips & Online Help for Podcasters", www.squidoo.com/podvox/, (downloaded Jul. 17, 2008).

"Text to Podcast", www.feedforall.com/text-to-podcast.htm, (downloaded Jul. 17, 2008). "Speechcast, text-to-speech Podcasting", www.enfoldsystems.com/Products/Open/speechcast, (downloaded Nov. 22, 2008).

"Terry Freedman's Educational Technology Podcast", www.podcastingnews.com/details/www.terryfreedman.org.uk/podcast/TF Educational Technology.xml/view.htm, (downloaded Aug. 27, 2008).

* cited by examiner

*Primary Examiner* — Martin Lerner
(74) *Attorney, Agent, or Firm* — Law Offices of Ira D. Blecker. P.C.

(57) ABSTRACT

Disclosed is a system and method for generating a web podcast interview that allows a single user to create his own multi-voices interview from his computer. The method allows the user to enter a set of questions from a text file using a text editor. (Answers may also be entered from a text file although this is not the more preferred embodiment.) For each question, the user may select one particular interviewer voice among a plurality of predefined interviewer voices, and by using a text-to-speech module in a text-to-speech server, each question is converted into an audio question having the selected interviewer voice. Then, the user preferably records answers to each audio question using a telephone. And a questions/answers sequence in a podcast compliant format is generated.

20 Claims, 5 Drawing Sheets

GENERATING A WEB PODCAST INTERVIEW BY SELECTING INTERVIEW VOICES THROUGH TEXT-TO-SPEECH SYNTHESIS

TECHNICAL FIELD

The present invention relates to the field of broadcasting technology and more particularly to a system and method for generating a web podcast.

BACKGROUND OF THE INVENTION

From "Wikipedia, the free encyclopaedia", a podcast is distinguished from other digital media formats by its ability to be downloaded automatically, using software capability of reading feed formats.

The emerging of new platforms such as satellite radio, podcasting and other digital delivery allows the new generation of business services to drive the market competition by being on the leading edge of the new platforms.

The podcasting technology allows direct downloads or streaming digital contents that allows a podcast provider to offer associated services. The offering of such podcasting services gains a large success in terms of business profitability. Moreover, a podcasting service generates a large interest to listeners who are discovering content that many other individuals listen to on the radio or TV through other means.

A podcasting service generally includes audio podcasting as well as video podcasting. From the following example, it is shown that a public affairs program on important events may be transmitted by using a video podcast media. Thereby, a video podcast can allow a podcasting provider to reach a large public audience on client request.

The use of the podcast media is very different from what any other radio or TV stations have been doing until now. The orientation of the new marketing techniques allows firms to be leaders in their business areas by providing specialized contents for new platforms, like podcasting, satellite radio and video via the Internet network. Also, these firms can distribute multiple podcasts and can initiate programs that include some community interaction tools to enable and enhance community conversation. By using a tool, like RSS (Really Simple Syndication), listeners can customize the programs they subscribe to, the ones that seem the most relevant to them, and can also interact and converse with the service providers to which they subscribe to. Producing a podcast is also an efficient medium to promote higher education that the universities can offer at no cost to any individual. Thereby, by offering the possibility to access free podcasts, plenty of individuals can attend to a plurality of courses including physics, history, psychology, geology, statistics, philosophy, economics, art and so on.

Even if the demand of listening to podcasts increases, the current technology needs to be improved to make podcasting easier to produce and distribute to clients. The diffusion of various podcasts with a higher quality has to be more attractive to satisfy clients when interacting with the podcasting service provider.

From a technology aspect, a podcast is based on a unidirectional diffusion, the source is referenced to a container that belongs to a podcasting service provider and, on clients' requests and convenience, the selected podcast is automatically pulled down.

As mentioned above, there are many podcast applications. Some of them consist of distributing audio, video, music, educative program and speech while the other ones have business objectives.

By business objective is meant the diffusion of a podcast message oriented business strategy when a firm wants to introduce a new product.

To enhance such a business strategy it is preferable to deliver a two-way marketing message communication to the audience rather than simply state the facts of the product. The objective of the two-way marketing message is to promote new product features, product quality, product performance and business application of the product. Thus, the firms involved in the business strategy determine an interview that seems the best method to challenge the facts of the product. Then, firms prepare questioning that seems for them the most challenging to promote their products. The more questions they ask, the more interested they appear. They create the adequate questions the system will ask during the interview and generate a client interview worksheet by using the podcast capabilities.

From the following example, it is shown that a basic question like, "You said Product_X is important, so why is it important?", initiates an interactive interview. Such an interactive interview satisfies the human need to challenge what people say and makes the interview more engaging.

In today's market strategy, the use of the podcast method is not compatible with the monitoring of an interactive interview when promoting a product to a client. Whereas the current podcasting method requires a single voice all along the podcast interview, it becomes more efficient to create a multi-voice interview when a business podcast interview is initiated.

The use of a single voice minimizes considerably the interest of the marketing message transmitted to the client. The voice can be monotonous and the marketing message can become boring. Then, clients stop listening and thereby miss some important marketing facts.

Another application domain of a podcasting service consists of educating people by using the multiple-voice interview that seems the most appropriate to the audience. From the following example, it is seen that the podcasting service perfectly suits the objective of an instructional designer in guiding some experts on their subject for which they have a vast amount of knowledge. Depending on the complexity of the subject, it is possible that the expert overlooks many significant points. Faced with this situation, the instructional designer may create a multi-voice interview containing some relevant questions to guide the expert to ensure that all the points are covered by his answers.

A last example shows that the interview approach is appropriate when a communication manager has to respond to a series of employee questions. The use of a second voice to ask the employee questions gives the appearance of neutrality throughout the interview.

From the examples cited here above, it is desirable to develop a multiple-way marketing message communication to the audience rather than simply state the facts of the product. The multiple-way marketing message turns around an interactive multi-voice interview that makes the business strategy more engaging when using the podcast capabilities. Incorporating such a multi-voice interactive interview concept is currently expensive, inflexible and time consuming. Indeed, the individuals involved in generating the multiple-way marketing message have to be present together when recording (probably at a studio). Each of them have to record their own part of the interview to be finally merged together to form a single podcast.

To summarize, the aforementioned methods present several drawbacks, some of the main drawbacks are:

- Existing business podcast methods simply state the facts of the product instead of delivering a two-way marketing message communication to the audience.
- Using a single voice all along the podcast interview minimizes considerably the interest of the marketing message transmitted to the client.
- Existing interview methods require a plurality of individuals to create an interview based on a multiple-voice concept. These individuals have to be present at the same time during the recording (probably at a studio). Alternatively, they could each record their respective parts and these would then be manually assembled into a single recording.

As mentioned above, prior art solutions are not fully appropriate with the generation of an interview based on a multiple voice approach. A single voice can be monotonous and the client can stop listening and thereby miss some important marketing facts. The fact of using a plurality of individuals to create a multiple voice interview leads to some constraints and inconveniences when working together in the same area. They have to be present at the same time and there is no flexibility when creating their respective parts of the interview. The existing methods do not allow assembling automatically the different voices belonging to the interview which generates an additional workload. The additional workload makes the existing methods to be expensive, inflexible and time consuming.

The present invention offers a solution to solve the aforementioned problems.

BRIEF SUMMARY OF THE INVENTION

Therefore, it is an object of the present invention to provide a multiple-voice interview podcast method and system which overcome the above issues of the prior art.

It is an object of the present invention to generate a questions-answers interactive interview worksheet based on podcast capabilities.

Another object of the present invention is to generate multiple voice formats and switch between them to take on different roles when interview is progressing.

It is a further object of the present invention to record a plurality of questions and associated answers from a single user.

It is another object of the present invention to record shorts pieces of audio and join the result into a single audio file.

Yet another object of the invention is to offer the ability to mix a text to speech with telephony recordings.

Finally, it is an object of the invention to mix and merge the resultant interview to form a single podcast meeting the marketing business strategy.

According to the invention, there is provided a system and method for generating a web podcast interview that allows a single user to create his own multi-voice interview from his computer. The method allows the user to enter a set of questions from a text file using a text editor. Although not the most preferred embodiment, answers may also be entered in a similar way using a text editor. For each question (and answer), the user may select one particular interviewer voice among a plurality of predefined interviewer voices, and by using a text-to-speech module in a text-to-speech server, each question (and answer) is converted into an audio question (and answer)_having the selected interviewer voice. Then, the user records answers to each audio question using a telephone. It is preferred that the user record answers by telephone to make the interview more interesting. And a questions/answers sequence in a podcast compliant format is generated.

More specifically, according to a first aspect of the invention, there is disclosed a method for generating a web podcast interview comprising the steps of:

receiving a set of questions in the form of a text file;

for each question:

selecting an interviewer voice among a plurality of predefined interviewer voices; and converting said question into an audio question having the selected interviewer voice;

receiving answers for each audio question; and generating a questions/answers sequence in a podcast compliant format, wherein the questions and answers are of different voices.

According to a second aspect of the invention, there is disclosed a system for generating a web podcast interview comprising:

an interview worksheet generator;

a WEB server;

a phone server;

an audio-file assembly server;

a text-to-speech server;

a user browser interface for interacting with the WEB server and interview worksheet generator; and a phone system interface for interacting with the phone server.

According to a third aspect of the invention, there is disclosed a computer readable storage medium storing instructions that, when executed by a computer, causes the computer to perform a method for generating a web podcast interview, the method comprising the steps of:

receiving a set of questions in the form of a text file;

for each question:

selecting an interviewer voice among a plurality of predefined interviewer voices; and converting said question into an audio question having the selected interviewer voice;

receiving answers for each audio question; and generating a questions/answers sequence in a podcast compliant format, wherein the questions and answers are of different voices.

According to a fourth aspect of the invention, there is disclosed a method for a web podcast interview generating service, the method comprising the steps of:

receiving a set of questions in the form of a text file;

for each question:

selecting an interviewer voice among a plurality of predefined interviewer voices; and converting said question into an audio question having the selected interviewer voice;

receiving answers for each audio question; and generating a questions/answers sequence in a podcast compliant format, wherein the questions and answers are of different voices.

Further aspects of the invention will now be described, by way of preferred implementation and examples, with reference to the accompanying figures.

BRIEF DESCRIPTION OF THE DRAWINGS

The above and other items, features and advantages of the invention will be better understood by reading the following more particular description of the invention in conjunction with the accompanying drawings wherein.

DETAILED DESCRIPTION OF THE INVENTION

Embodiments of the invention are described herein after by way of examples with reference to the accompanying Figures.

More specifically, according to a first aspect, the present invention consists of a multi-way interview podcasting system, herein named Multi-Voice Interactive Interview System (MVIIS), and a method allowing a podcasting generation of an interactive multi-voice interview worksheet.

Figure 1:
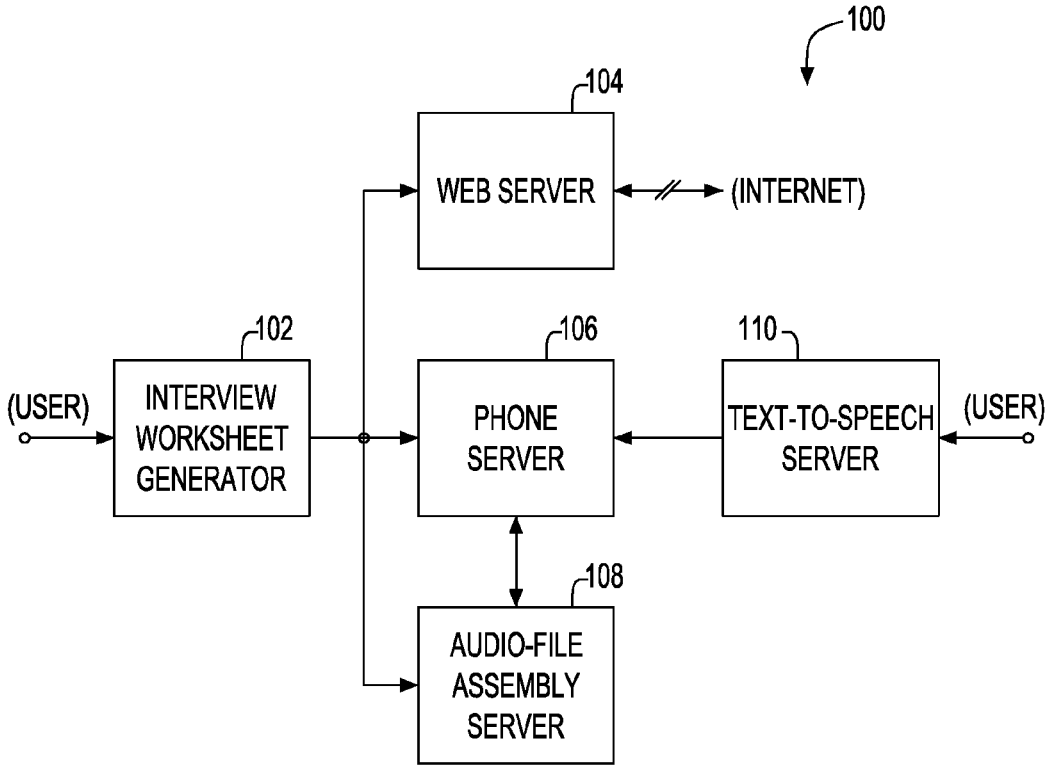
FIG. 1 shows a block diagram of a preferred implementation of the present invention.

FIG. 1 illustrates by schematic block diagram a preferred environment (100) for practising the invention. The preferred environment (100) includes an Interview Worksheet Generator (102), a WEB Server (104), a Phone Server (106), an Audio-file Assembly Server (108) and a Text-to-Speech Server (TTS) (110).

The WEB Server (104), the Phone Server (106) as well as the Audio-file Assembly Server (108) receive the interview podcast instructions from the user (user) through the Interview Worksheet Generator (102). The Interview Worksheet Generator (102) communicates with the WEB Server (104). The WEB Server (104) interfaces with a system network like LAN, WAN or the Internet. The Text-to-Speech Server (110) allows the user (user) to convert an interview text file into a corresponding audio file.

Each generated audio file is stored into the Phone Server (106) after validation by the user (user).

The Interview Worksheet Generator (102) provides the Phone Server (106) with the interview questions related to a defined context and allows the user (user) to store the associated answers accordingly.

The Audio-file Assembly Server (108) mixes and merges sequentially all the audio files extracted from the Phone Server (106) and produces a resultant MPEG file (.mp3) that is compliant with the podcasting capabilities.

MPEG is the acronym for Motion Picture Editors Guild. A file encoding in .mp3 format is a MPEG-1 Audio Layer 3 digital audio encoding format. It uses a compression algorithm that is designed to greatly reduce the amount of data required to represent the audio recording, yet still sound like a faithful reproduction of the original uncompressed audio to most listeners.

The resultant MPEG file (.mp3) is stored in the WEB Server (104) to be available on the network.

It is to be noted that depending on the multimedia container format standard the format of the MPEG file can be either generated in .mp3 or .m4a or .m4 or .m4p or .m4v that are most modern formats to allow streaming of a podcast over the Internet.

Figure 2:
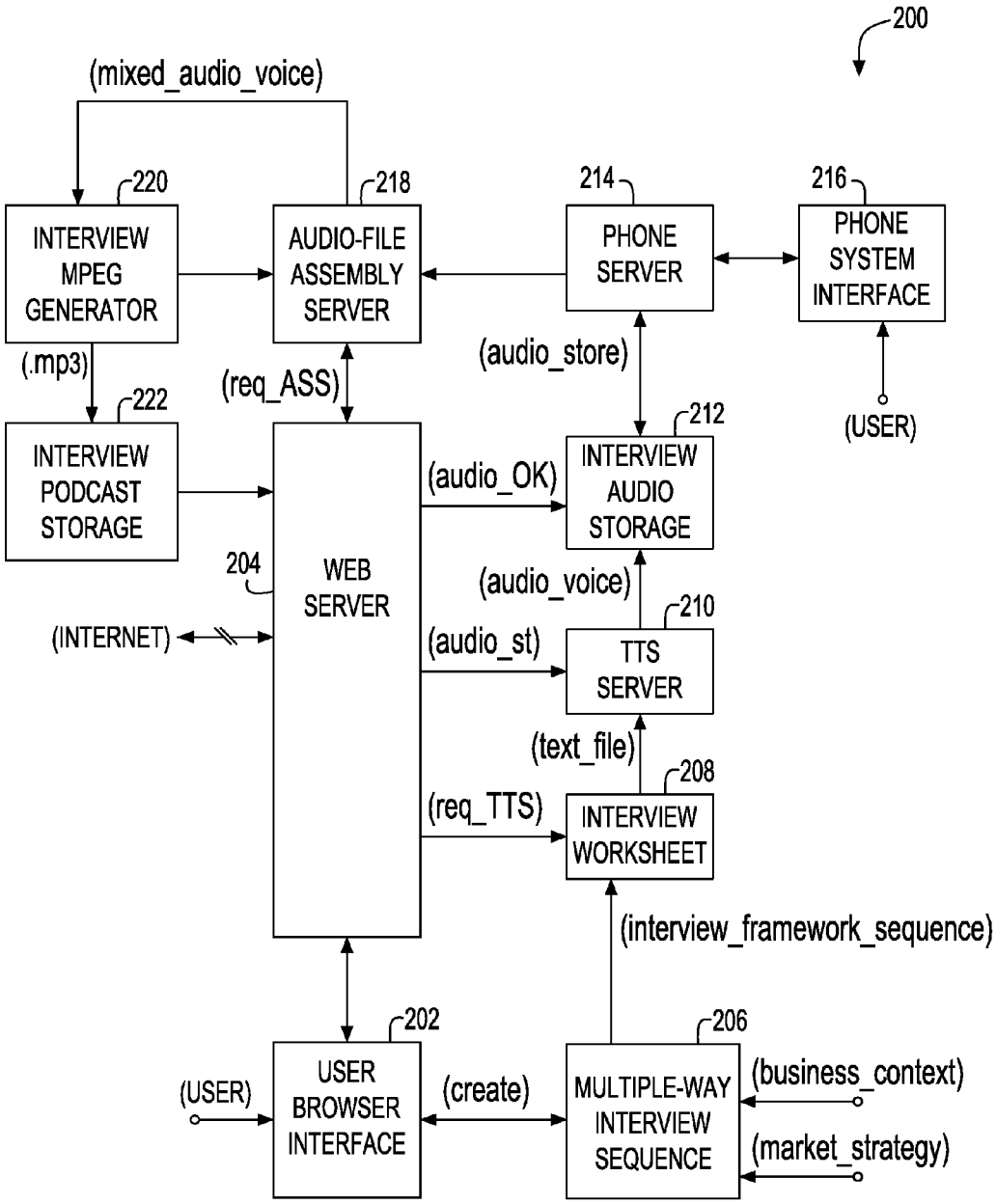
FIG. 2 depicts the functional relationship of the components of the Multi-Voice Interactive Interview System of the present invention.

FIG. 2 depicts the functional relationship between the components illustrated in FIG. 1. The Multi-Voice Interactive Interview System (MVIIS) (200) operates in various business contexts. The method allows a user (user) to generate an interview worksheet oriented marketing strategy and business context that is compliant with the podcasting capabilities.

MVIIS (200) comprises a Multiple-way Interview sequence (206) and an Interview Worksheet (208) coupled to several servers (WEB server (204), Text-to-Speech Server (210), Phone Server (214), Audio-file Assembly Server (218)) and their associated components (User Browser Interface (202), Interview Audio Storage (212), Phone System Interface (216), Interview Mpeg Generator (220), Interview Podcast Storage database (222)). These associated components monitor and control all the requirements related to the multi-voice interview generation and its associated podcasting conversion.

Both the Multiple-way Interview sequence (206) and the Interview Worksheet (208) form the Interview Worksheet Generator (102 of FIG. 1).

The Multiple-way Interview sequence (206) receives both the directives of a business context (business_context) and a market strategy (market_strategy) to be posted by the Interview Worksheet (208) onto the Text-to-Speech Server (210).

The business context consists in providing the Multiple-way Interview sequence (206) with some predefined questions-answers guidelines that qualify the domain in which the business operates.

The market strategy consists in providing the Multiple-way Interview sequence (206) with some predefined questions-answers guidelines that promote interest in, and generate demands for, a product or a service.

Directives may be forwarded from a variety of external sources that are not shown in the FIG. 2, such as servers, peer-to-peer communications, administrator workstations or other supports that those skilled in the art can easily comprehend.

MVIIS incorporates a User Browser Interface (202) and a Phone System Interface (216).

The User Browser Interface (202) serves as an interconnection between the WEB Server (204), the Multiple-way Interview sequence (206) and the user (user).

The Phone System Interface (216) serves as an interconnection between the Phone Server (214) and the user (user) that accesses it by dialing the system.

The User Browser Interface (202) allows the user (user) to connect to WEB Server (204), to initiate a podcasting instruction and to create (create) an interview framework sequence (interview_framework_sequence) through the Multiple-way Interview sequence (206) and the Interview Worksheet (208).

The podcasting instruction means that a user (user) can request a MVIIS instruction, like a Text-to-Speech conversion (req_TTS), a Text-to-Speech Server streaming (audio_st), an audio file validation (audio_OK) and/or an Audio-file Assembly request (req_ASS).

An interview framework sequence means that a user (user) can initiate an interview sequence by typing the questions one after the other and prepare the answers accordingly.

The Multiple-way Interview sequence (206) gives the user (user) the possibility to add different voices on the fly by switching from a single-voice to multiple-voices all along the interview worksheet generation.

The Interview Worksheet (208) delivers a text file (text_file) of the interview framework sequence (interview_framework_sequence) to the Text-to-Speech Server (210).

The text file (text_file) contains a list of questions and answers that represents the most appropriate scenario for challenging the features of a new product. One or more text files (text_file) are available in the interview worksheet (208). In the invention, only one text file highlights the stream between the Interview Worksheet (208) and the Text-to-Speech server (210).

The activation of the Text-to-Speech Server (210) comes on user request (req_TTS). The Text-to-Speech Server (210) converts the interview text file (text_file) into a corresponding audio file (audio_voice). The Text-to-Speech Server (210) streams the audio file (audio_st), through the WEB server (204) and the User browser interface (202). Then the user (user) can check the validity of audio file that was text to speech converted (audio_OK).

The Text-to-Speech Server (210) provides the Interview Audio Storage (212) with a correct audio file (audio_voice) to be posted on the Phone Server (214).

The Phone Server (214) gets the scenario of the interview framework sequence that the user (user) requests through the Phone System Interface (216). The Phone System Interface (216) coordinates the access to the stored questions. It allows the user (user) to record the answers that are convenient to the Interview worksheet (208) and store (audio_store) them into the Interview Audio Storage (212). The audio file recording loops until the end of the interview framework sequence occurs.

The activation of the Audio-file Assembly Server (218) comes on user request (req_ASS). The Audio-file Assembly Server (218) gets the audio voices from the Phone Server (214), concatenates and mixes them sequentially, and creates a resultant mix file, named mixed_audio_voice.

The Interview Mpeg Generator (220) gets the resultant mix file (mixed_audio_voice) from the Audio-file Assembly Server (218) and produces the corresponding audio files in .mp3 format (.mp3), after encoding. Thereby, the Interview Mpeg Generator (220) creates an interview podcast content.

The interview podcast is stored into an Interview Podcast Storage database (222) that allows a subscriber to request fetching over the network (Internet). Thus, portable media players, PCs and mobile phones can fetch the audio files directly from the Interview Podcast Storage database (220) via the WEB server (204).

Figure 3:
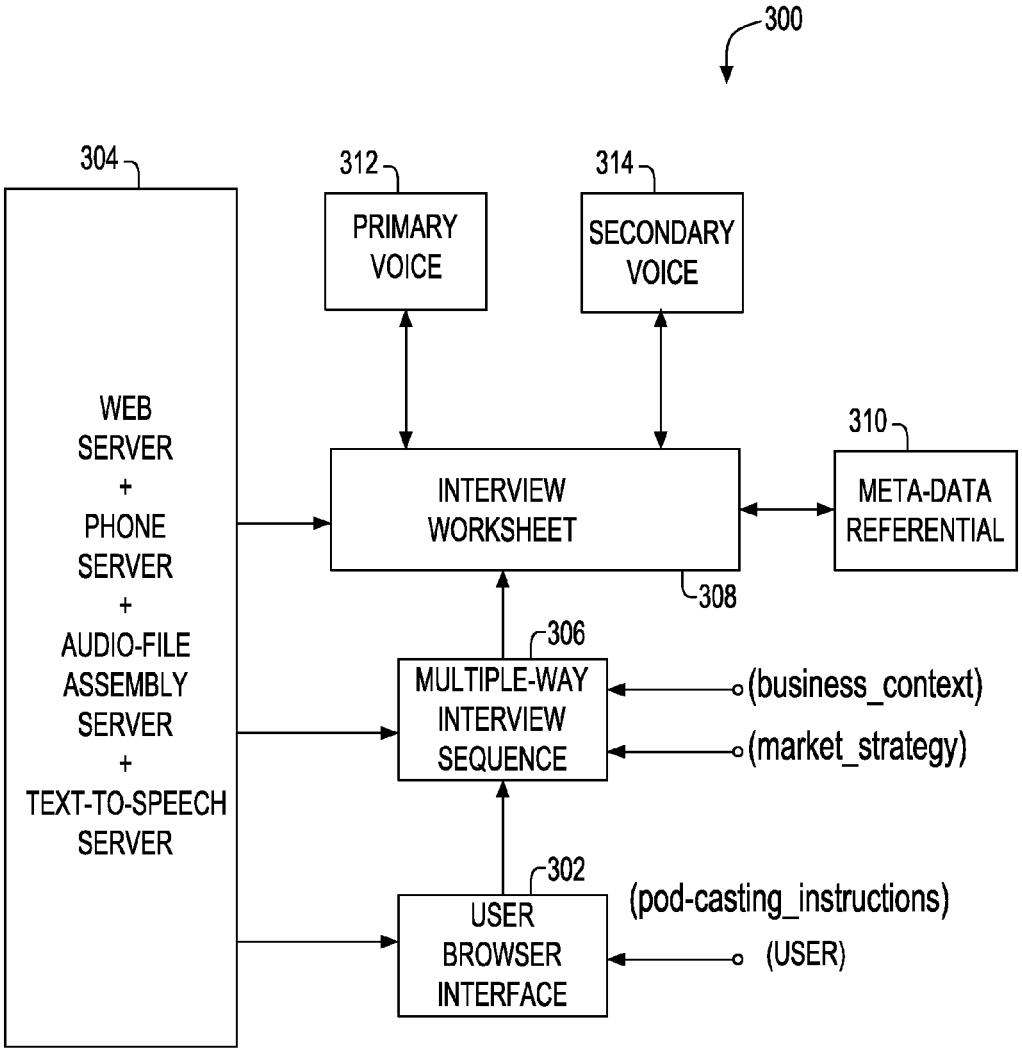
FIG. 3 illustrates the concept of Interview Worksheet Generator as may be applicable to the Multi-Voice Interactive Interview System of the present invention.

FIG. 3 illustrates the generation of the interview worksheet as may be applicable to the Multi-Voice Interactive Interview System (MVIIS) of the invention.

The Interview Worksheet Generator (300) consists in using a single source to create the interview worksheet rather than using multiple sources to generate an interactive dialog all along the podcast diffusion. A single source means that the Interview Worksheet Generator (300) requires a single user to create and record an interview podcast of one and/or multiple voices.

As symbolized both in FIG. 1 and FIG. 2, the Interview Worksheet Generator (300) includes a Multiple-way Interview sequence (306) and an Interview Worksheet (308) in which is articulated several components (User Browser Interface (302), Text-to-speech server (304), Meta-Data-Referential (310), Primary Voice (312), Secondary Voice (314)). These components generate and transform the typed text into a suitable podcast format.

The Multiple-way Interview sequence (306) receives the interview ground rules containing the firm directives of the business context (business_context) and the market strategy (market_strategy) from external sources (not represented in the FIG. 3).

A User Browser interface (302) presents a WEB page to the user to enter his/her user podcasting instructions (podcasting_instructions) to be transmitted afterwards to the Multiple-way Interview sequence (306).

The WEB page provides the user with the necessary interface to type and create through a Text-to-speech server (304) the adequate recordings. Thus, the Multiple-way Interview sequence (306) can generate the interview framework sequence (interview_framework_sequence) accordingly. The interview framework sequence is transmitted to the Interview Worksheet (308).

The use of multiple voices allows the user (user) to record a primary voice (312) that asks questions, comments or exchange conversation as well as to record a secondary one (314) to outbid the marketing message. The primary voice (312) and secondary voice (314) may be selected from a plurality of predefined interviewer voices. There is associated a text-to-speech module in the text-to-speech server 304 to each of the predefined interviewer voices. The user, while creating the Interview Worksheet (308) incorporates some metadata qualifiers, via a Meta-Data-Referential (310), identifying the primary voice (312) content, like a telephone number to call, a user ID and a password to be used later when accessing to the voice recordings.

The role of the secondary voice (314) is like a virtual attendee. The secondary voice (314) manages the marketing point that needs emphasizing during the interview. The secondary voice (314) generates the adequate questions and provides the pertinent answers that fit with the ongoing business context and market strategy. The merging of both the primary and secondary voices outbids the marketing interest of the audience when listening to the podcast diffusion.

Then, the user (user) determines an interview framework sequence (interview_framework_sequence) that seems the most appropriate scenario for challenging the features of a new product. Firstly, the user creates some key questions oriented to market strategy that the primary voice (312) will ask during the interview. Secondly, the user customizes the message that the secondary voice (314), working the same as a virtual attendee, will deliver in accordance with the current question.

The more marketing message questions the primary and the secondary voices ask, the more interested the marketing message appears. In operation, the Interview Worksheet (308) communicates with a plurality of servers (304) to transform the text the user types into a suitable podcast format. The functional relationship between the components that act all along the transformation of a typed text into a 1 suitable podcast format has been already described in FIG.2.

Figure 4:
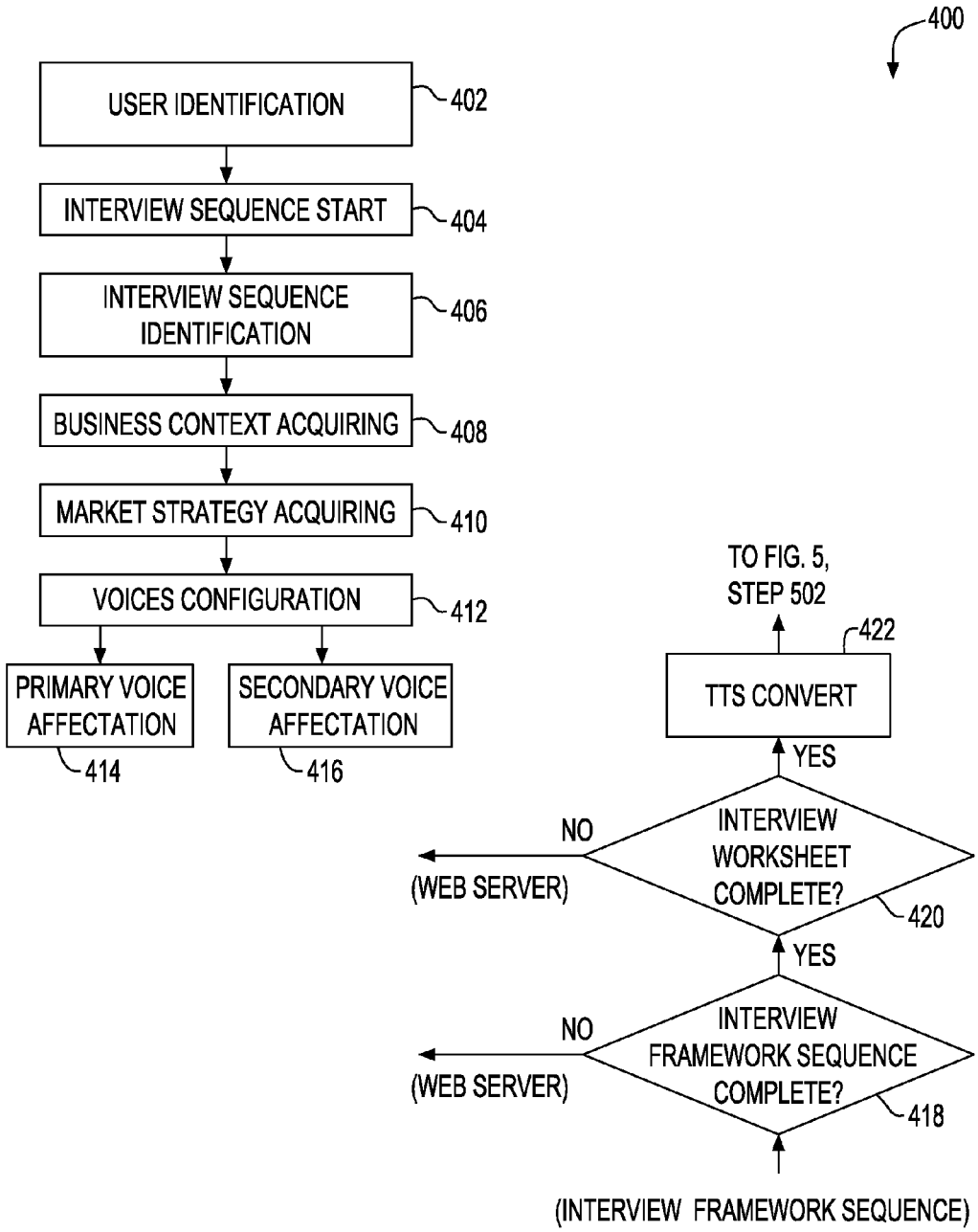
FIG. 4 represents a flow chart process of the Multi-Voice Interactive Interview System when the user generates an interview worksheet to be converted in audio file format.

Referring to FIG. 4, a flow chart process represents the Multi-Voice Interactive Interview System (MVIIS) when the user generates an interview worksheet and converts it in audio file format. Based on a progressive approach, the interview worksheet gets some external parameters allowing a text file generation of the multi voice interview all along the process. Business context, marketing strategy as well as metadata of the podcast are considered as external parameters.

Step 402 (User Identification): User connects to a Web server, via a user browser interface, and signs in to initiate an interview podcasting procedure. Then, the process goes to step 404.

Step 404 (Interview Sequence Start): Web server initiates the interview podcasting procedure. Either the interview podcasting procedure provides the user with a background interview framework sequence for updating or allows him/her to create a new one. An interview worksheet is generated accordingly. Then, the process goes to step 406.

Step 406 (Interview Sequence Identification): For satisfying the RSS requirements (Really Simple Syndication), the user inserts metadata qualifiers, like title of podcast and/or abstract that allows identifying a podcast. The user types a text via the user browser interface and the Interview Worksheet is upgraded accordingly. Then, the process goes to step 408.

Step 408 (Business Context Acquiring): User selects a business context from a list (not described here) by typing the adequate podcasting instruction. The Interview framework sequence acquires a business context. The business context provides the appended guidelines that are used to generate a business-oriented interview. The interview worksheet receives the upgraded interview framework sequence that serves as reference for generating the multi-voice interview. Then, the process goes to step 410.

Step 410 (Market Strategy Acquiring): User selects a market strategy from a list (not described here) by typing the adequate podcasting instruction. The Interview framework sequence acquires the market strategy. The market strategy provides the appended guidelines that are used to generate a marketing-oriented interview. The interview worksheet receives the upgraded interview framework sequence that serves as reference for generating the multi-voice interview. Then, the process goes to step 412.

Step 412 (Voices Configuration): User sets up and configures voices that interact all along the interview by entering the adequate podcasting instruction. During the configuration the interview framework sequence transmits the interview guidelines previously created in steps 404, 408 and 410. Firstly, the process goes to step 414 allowing the user to generate the primary voice. Secondly, the process goes to step 416 allowing the user to generate the additional voice, named secondary voice in the present invention.

Step 414 (Primary Voice Affectation): User creates questions concerning the primary voice. User follows the guidelines posted in the interview framework and affects a text to the primary voice via the user browser interface. Then, the Interview Worksheet is upgraded by receiving the primary voice content and the process goes to step 418.

Step 416 (Additional Voice Affectation): User creates answers and/or outbid-questions concerning at least one secondary voice or more (depending on the user configuration).

User follows the guidelines posted in the interview framework and affects a text to the additional voice via the user browser interface. Then, the Interview Worksheet is upgraded by receiving the additional voice content and the process goes to step 418.

From Step 404 up to Step 416, the Interview Worksheet concatenates the interview framework sequences, the metadata qualifiers of the podcast, the primary voice content and, at least, a secondary voice content and may be more voice contents to a text file.

Next on step 418, a status is made to check the completion of the interview framework sequence. If the interview framework sequence is complete the process goes to step 420; otherwise the process loops back to a recovery step previously assigned (not described here) via the web server.

Next on step 420, a status is made to check the completion of the interview worksheet. If the interview worksheet is complete the process goes to step 422; otherwise the process loops back to a recovery step previously assigned (not described here) via the web server.

Step 422 (Text to Speech Conversion): User requests Text to Speech conversion. The text file is sent to Text-to-Speech Server for conversion into an audio file. It is to be noted that step 422 ends the first-part of the Multi-Voice Interactive Interview System process. From this step, the Text to Speech converter presents the multi-voice interview audio file that the second-part of the Multi-Voice Interactive Interview System process needs to produce the podcast, as now described in FIG. 5.

Figure 5:
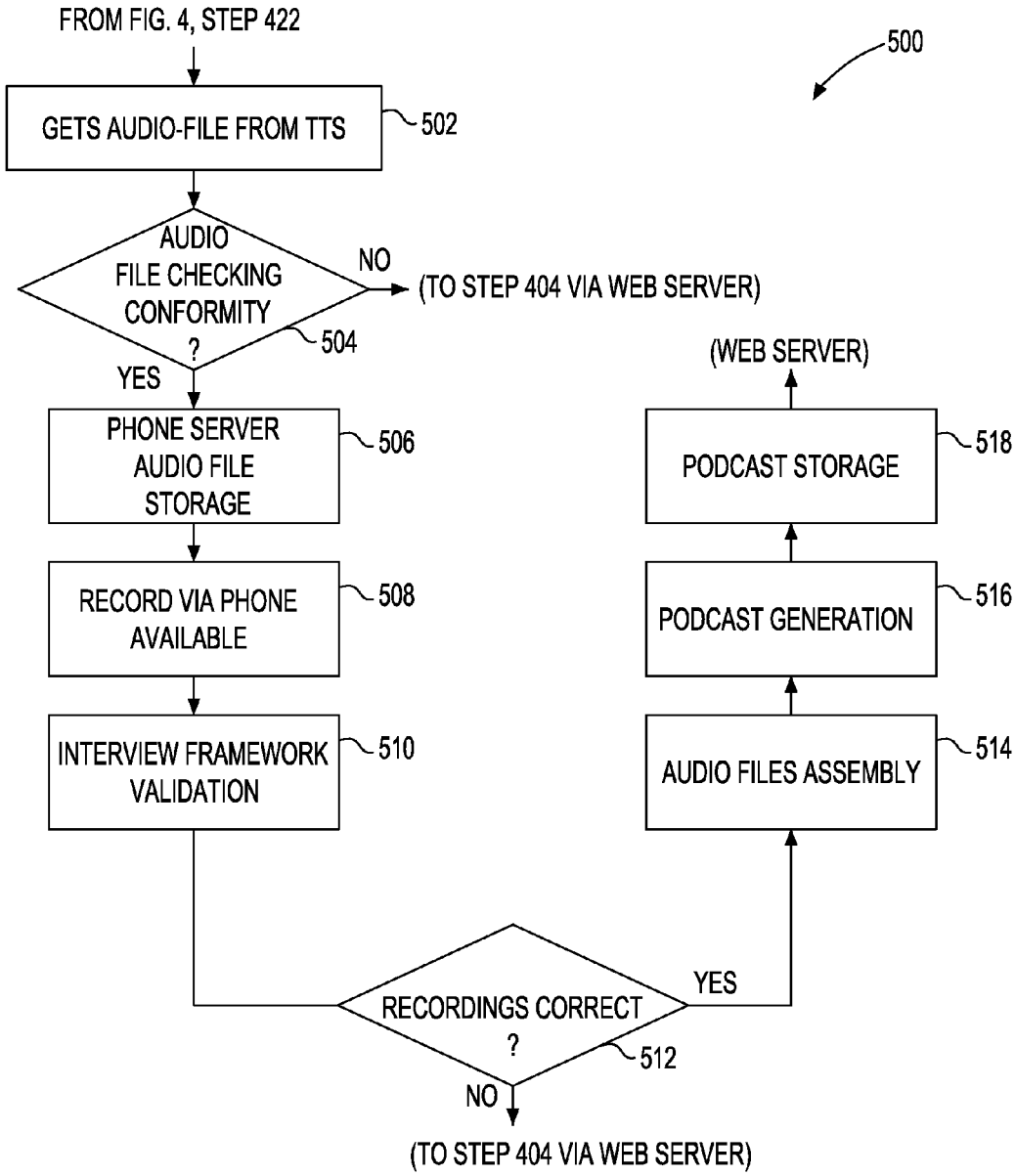
FIG. 5 represents a flow chart process of the Multi-Voice Interactive Interview System when the user converts a multi-voice interview audio file to a podcast by using the podcast capabilities.

Going now to FIG. 5, a flow chart describing the process when a user converts a multi-voice interview audio file to a podcast by using the podcast capabilities.

Step 502: Second-part process starts. The process gets the multi-voice audio-file from the Text-to-Speech server as described in FIG. 4 step 422. Then, the process goes to step 504.

Step 504 (Audio File Checking Conformity): Text-to-Speech server streams the audio files through the Web server to be validated by the user via the user browser interface. The user checks the conformity of the audio file issued from the text to speech conversion. If the audio file is conformed to the user expectation (branch Yes of the comparator 504) the process goes to step 506 else (branch No of the comparator 504) the process returns to step 404 (FIG. 4) via the WEB server.

Step 506 (Phone Server audio file storage): User stores the audio files into the Phone Server. Then, the process goes to step 508.

Step 508 (Recordings via Phone Available): User requests recordings of answers to be made available via a phone system interface. Then, the process goes to step 510. It should be noted that answers may also be recorded in the Interview Sequence Identification (step 406), which would then be subsequently converted to speech by the Text to Speech Conversion (step 422), but recording answers from a person by telephone makes the interview more interesting and is thus preferred.

Step 510 (Interview Framework Validation): User checks the recording content conformity by using the Phone Server. Questions and associated answers of the ongoing interview are stored in the Phone Server. To validate the recording content of the interview, user dials via the phone system interface and accesses the recordings for an instant interview playback review. Then the process goes to step 512.

Step 512: A status provides the user with the validity of the recording content. If the validation confirms that the ongoing interview is not correct (branch No of the comparator 512), the process returns to step 404 (FIG.4) via the WEB server. Going to step 404, as shown in FIG.4, allows the user to update and arrange both questions and answers accordingly. Then the second-part of the Multi-Voice Interactive Interview System process returns to step 502. From step 502 up to 510, the process executes the operations the one after the other till completion. If the validation confirms that the ongoing interview is correct (branch Yes of the comparator 512), the process goes to step 514 denoting that the recordings are complete.

Step 514 (Audio File Assembly): User requests audio files assembly via the user browser interface. Audio-file Assembly Server assembles sequentially all the audio files belonging to the interview and forms a mixed audio file. Then, the process goes to step 516.

Step 516 (Podcast Generation): Audio-file Assembly Server produces a resultant MPEG file (.mp3) that is compliant with the podcasting capabilities. Then, the process goes to step 518.

Step 518 (Podcast Storage): Audio-file Assembly Server transmits the MPEG file on the WEB Server for storage to be listened to by a Client over the Internet.

It has to be appreciated that while the invention has been particularly shown and described with reference to a preferred embodiment, various changes in form and detail may be made therein without departing from the spirit, and scope of the invention.

The invention claimed is:

1. A method for generating a web podcast interview comprising the steps of:

responsive to a user providing an interview sequence comprising questions and answers, generating an interview worksheet including the interview sequence;

selecting a primary interviewer voice among a plurality of predefined interviewer voices, configuring the primary interviewer voice to ask at least one question in the interview sequence and affecting a text from the interview sequence to the primary interviewer voice;

updating the interview worksheet with the primary interviewer voice text;

selecting a secondary interviewer voice among a plurality of predefined interviewer voices, configuring the secondary interviewer voice to answer at least one question in the interview sequence and affecting a text from the interview sequence to the secondary interviewer voice;

updating the interview worksheet with the secondary interviewer voice text;

concatenating by the interview worksheet the interview sequence, primary voice text and secondary voice text to a text file;

converting by a text-to-speech module the text file into an audio file; and generating a questions/answers sequence in a podcast compliant format, wherein the questions and answers are of different voices;

wherein one or more of the steps of the method are performed using a computer.

2. The method of claim 1 further comprising after the generating step, the step of storing the questions/answers sequence on a web server.

3. The method of claim 1 wherein the questions/answers sequence is a single file.

4. The method of claim 1 wherein the podcast compliant format is one from the group of .mp3,.m4a, .m4, .m4p or .m4v format.

5. The method of claim 1 further comprising an initial step of invoking a podcasting application through a user browser interface.

6. The method of claim 5 further comprising the step of creating a source of predefined interviewer voices.

7. The method of claim 5 further comprising the step of associating a text-to-speech module to each of the predefined interviewer voices.

8. The method of claim 1 wherein prior to the step of converting further comprising the step of updating the interview worksheet with directives of a business context and directives of a market strategy.

9. A system for generating a web podcast interview sequence of questions and answers comprising:

an interview worksheet generator comprising a plurality of predefined interviewer voices and an interview worksheet including the interview sequence wherein, in operation:

a primary interviewer voice among the plurality of predefined interviewer voices is selected, the primary interviewer voice is configured to ask at least one question in the interview sequence and a text from the interview sequence is affected to the primary interviewer voice;

a secondary interviewer voice among a plurality of predefined interviewer voices is selected, the secondary interviewer voice is configured to answer at least one question in the interview sequence and a text from the interview sequence is affected to the secondary interviewer voice;

the interview worksheet is updated with the primary voice text and the secondary interviewer voice text; and the interview sequence, primary voice text and secondary voice text is concatenated by the interview worksheet to a text file;

a WEB server;

a phone server;

an audio-file assembly server;

a text-to-speech server to convert the text file to an audio file;

a user browser interface for interacting with the WEB server and interview worksheet generator; and a phone system interface for interacting with the phone server.

10. A computer readable storage medium storing instructions that, when executed by a computer, causes the computer to perform a method for generating a web podcast interview, the method comprising the steps of:

responsive to a user providing an interview sequence comprising questions and answers, generating an interview worksheet including the interview sequence;

selecting a primary interviewer voice among a plurality of predefined interviewer voices, configuring the primary interviewer voice to ask at least one question in the interview sequence and affecting a text from the interview sequence to the primary interviewer voice;

updating the interview worksheet with the primary interviewer voice text;

selecting a secondary interviewer voice among a plurality of predefined interviewer voices, configuring the secondary interviewer voice to answer at least one question in the interview sequence and affecting a text from the interview sequence to the secondary interviewer voice;

updating the interview worksheet with the secondary interviewer voice text;concatenating by the interview worksheet the interview sequence, primary voice text and secondary voice text to a text file;

converting by a text-to-speech module the text file into an audio file; and generating a questions/answers sequence in a podcast compliant format, wherein the questions and answers are of different voices;

wherein one or more of the steps of the method are performed using a computer.

11. The computer readable storage medium of claim 10 further comprising after the generating step, the step of storing the questions/answers sequence on a web server.

12. The computer readable storage medium of claim 10 wherein the questions/answers sequence is a single file.

13. The computer readable storage medium of claim 10 wherein the podcast compliant format is one from the group of .mp3,.m4a, .m4, .m4p or .m4v format.

14. The computer readable storage medium of claim 10 further comprising an initial step of invoking a podcasting application through a user browser interface.

15. The computer readable storage medium of claim 14 further comprising the step of creating a source of predefined interviewer voices.

16. The computer readable storage medium of claim 14 further comprising the step of associating a text-to-speech module to each of the predefined interviewer voices.

17. The computer readable storage medium of claim 10 wherein prior to the step of converting further comprising the step of updating the interview worksheet with directives of a business context and directives of a market strategy.

18. A method for a web podcast interview generating service, the method comprising the steps of:

responsive to a user providing an interview sequence comprising questions and answers, generating an interview worksheet including the interview sequence;

selecting a primary interviewer voice among a plurality of predefined interviewer voices, configuring the primary interviewer voice to ask at least one question in the interview sequence and affecting a text from the interview sequence to the primary interviewer voice;

updating the interview worksheet with the primary interviewer voice text;

selecting a secondary interviewer voice among a plurality of predefined interviewer voices, configuring the secondary interviewer voice to answer at least one question in the interview sequence and affecting a text from the interview sequence to the secondary interviewer voice;

updating the interview worksheet with the secondary interviewer voice text;concatenating by the interview worksheet the interview sequence, primary voice text and secondary voice text to a text file;

converting by a text-to-speech module the text file into an audio file; and generating a questions/answers sequence in a podcast compliant format, wherein the questions and answers are of different voices;

wherein one or more of the steps of the method are performed using a computer.

19. The method of claim 18 further comprising the step of storing the questions/answers sequence on a web server.

20. The method of claim 18 wherein prior to the step of converting further comprising the step of updating the interview worksheet with directives of a business context and directives of a market strategy.

* * * * *